US011214970B2

(12) United States Patent
Henikl et al.

(10) Patent No.: US 11,214,970 B2
(45) Date of Patent: Jan. 4, 2022

(54) REMOTE CONTROL DEVICE FOR A LARGE MANIPULATOR HAVING A CONTROL LEVER

(71) Applicant: Schwing GmbH, Herne (DE)

(72) Inventors: Johannes Henikl, Essen (DE); Reiner Vierkotten, Oberhausen (DE)

(73) Assignee: SCHWING GMBH, Herne (DE)

( * ) Notice: Subject to any disclaimer, the term of this patent is extended or adjusted under 35 U.S.C. 154(b) by 250 days.

(21) Appl. No.: 16/091,908

(22) PCT Filed: Apr. 4, 2017

(86) PCT No.: PCT/EP2017/057981
§ 371 (c)(1),
(2) Date: Oct. 15, 2018

(87) PCT Pub. No.: WO2017/174576
PCT Pub. Date: Oct. 12, 2017

(65) Prior Publication Data

US 2019/0055741 A1 Feb. 21, 2019

(30) Foreign Application Priority Data

Apr. 7, 2016 (DE) ..... 10 2016 106 352.5

(51) Int. Cl.
*E04G 21/04* (2006.01)
*E02F 9/20* (2006.01)
(Continued)

(52) U.S. Cl.
CPC ..... *E04G 21/0463* (2013.01); *A63H 30/04* (2013.01); *E02F 9/205* (2013.01);
(Continued)

(58) Field of Classification Search
CPC .. E04G 21/0463; E04G 21/0454; G05G 5/05; G05G 9/047
See application file for complete search history.

(56) References Cited

U.S. PATENT DOCUMENTS 5,086,870 A 2/1992 Bolduc
5,128,671 A 7/1992 Thomas, Jr.
(Continued)

FOREIGN PATENT DOCUMENTS

EP 0686224 B1 12/1995
EP 1373661 A1 1/2004
EP 2508680 A1 10/2012

OTHER PUBLICATIONS

International Preliminary Report on Patentability issued in PCT/EP2017/057981, dated Oct. 18, 2018, 9 pages.
(Continued)

*Primary Examiner* — Vicky A Johnson
(74) *Attorney, Agent, or Firm* — Faegre Drinker Biddle & Reath LLP

(57) ABSTRACT

A device includes a remote control apparatus with a control lever that is pivotably mounted to the remote control apparatus. The control lever is pivotable within an inner zero-position range, an outer travel range, and an oscillation damping range located between the inner zero-position range and the outer travel range. The remote control apparatus is configured to cause movement of a large manipulator, which has an active oscillation damping mode, switch on the active oscillation damping mode and cause movement of the large manipulator when the control lever is within the outer travel range, switch off the active oscillation damping mode when the control lever is located in the zero-position range, and switch on the active oscillation damping mode without causing movement of the large manipulator when
(Continued)

Figure 1:
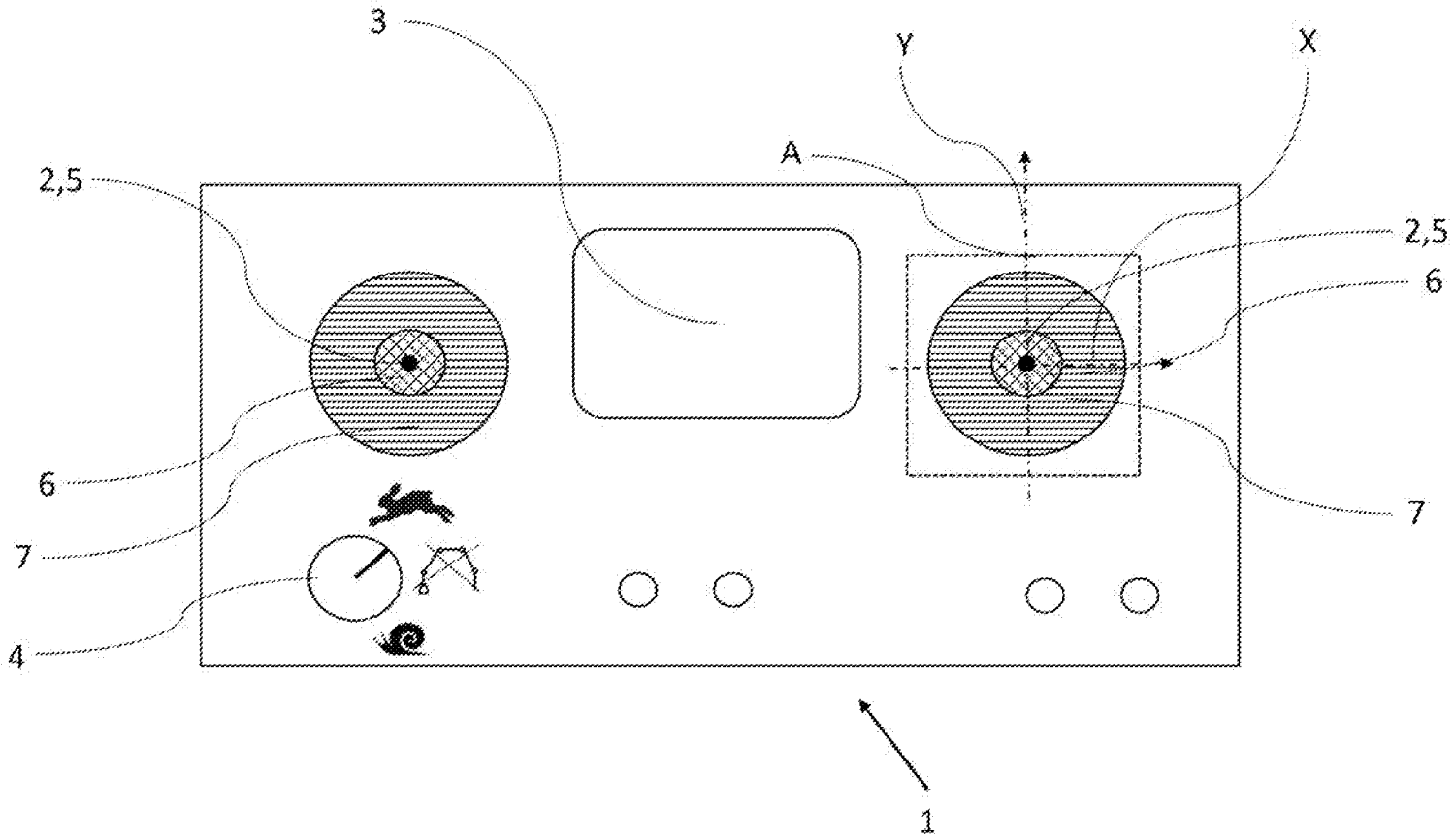

the control lever is located within the oscillation damping range.

6 Claims, 6 Drawing Sheets

(51) Int. Cl.
*A63H 30/04* (2006.01)
*G05G 5/05* (2006.01)
*G05G 9/047* (2006.01)

(52) U.S. Cl.
CPC ..... *E04G 21/0436* (2013.01); *E04G 21/0454* (2013.01); *G05G 5/05* (2013.01); *G05G 9/047* (2013.01); *E02F 9/2004* (2013.01)

(56) References Cited

U.S. PATENT DOCUMENTS 5,249,272 A 9/1993 Stern
5,640,996 A * 6/1997 Schlecht ..... B66C 13/40 137/615
6,002,351 A 12/1999 Takeda et al.
6,446,747 B1 9/2002 Müller et al.
7,657,355 B2 * 2/2010 Rau ..... B66C 13/40 701/50
7,729,832 B2 * 6/2010 Benckert ..... B66C 13/40 701/49
8,545,323 B2 10/2013 McVicar et al.
2008/0162005 A1 * 7/2008 Tang ..... B66C 13/40 701/50
2016/0185359 A1 * 6/2016 Mayer ..... B60W 50/14 701/2
2016/0223313 A1 * 8/2016 Vierkotten ..... B66C 13/46

OTHER PUBLICATIONS

International Search Report and Written Opinion issued in PCT/EP2017/057981, dated Jun. 21, 2017, 10 pages.
Wikipedia, "Analog stick", https://en.wikipedia.org/wiki/Analog_stick, downloaded May 14, 2019, 5 pages.
Wikipedia, "Centre stick", https://en.wikipedia.org/wiki/Centre_stick, downloaded May 14, 2019, 2 pages.
Wikipedia, "Joystick", https://en.wikipedia.org/wiki/Joystick, downloaded May 14, 2019, 8 pages.
Wikipedia, "Spring (device)", https://en.wikipedia.org/wiki/Spring (device), downloaded May 14, 2019, 8 pages.

* cited by examiner

REMOTE CONTROL DEVICE FOR A LARGE MANIPULATOR HAVING A CONTROL LEVER

CROSS-REFERENCE TO RELATED APPLICATION

This application is a U.S. 371 Application of International Application No. PCT/EP2017/057981, filed Apr. 4, 2017, which claims priority to Germany Patent Application No. 10 2016 106 352.5, filed Apr. 7, 2016, both of which are herein incorporated by reference in their entireties.

The invention relates to a device for controlling large manipulators, in particular distributor booms of truck-mounted concrete pumps, having a remote control apparatus by way of which an active oscillation damping of the large manipulator is capable of being switched on and off, and which has at least one control lever which on the remote control apparatus is mounted so as to be pivotable about an initial position about at least one pivot axis that runs so as to be orthogonal to the longitudinal axis of said control lever and which, depending on the pivot angle, in relation to the initial position of said control lever has an inner zero-position range and an outer travel range, wherein the active oscillation damping is switched on when the control lever is located in the travel range.

Large manipulators are used, for example, in truck-mounted concrete pumps in which concrete is pumped by way of a pump through a conveyor line. The conveyor line is guided along a distributor boom in multiple parts. The external end of the conveyor line (end hose) when in use is suspended so as to swing freely on the tip of the distributor boom. The distributor boom is composed of one or a plurality of segments which by way of drives are capable of being folded in relation to one another, and is mounted so as to be pivotable on the stationary or mobile platform. By way of the distributor boom it is possible for concrete to be distributed through the conveyor line across wide distances in a precisely targeted manner. The positioning of the distributor boom is performed by a machine operator by way of the remote control apparatus. The fine adjustment when distributing the concrete at the freely swinging end of the conveyor line is carried out by a further operator.

The boom, in particular at the tip thereof, can be set in oscillation in the event of movements of the distributer boom. Said oscillations are particularly intense in the event of an abrupt stoppage when the boom tip has reached the destination of the latter. However, on account of the pulsed conveying of the concrete, oscillations also arise, in particular at the tip of the boom, when the boom is not moved and concrete is pumped through the conveyor line.

In order for said oscillations to be kept within an acceptable level, modern large manipulators are equipped with an active oscillation damping which is capable of being switched on by the machine operator by way of the remote control apparatus. According to Directive 2006/42/EG (machine directive) of the European Parliament, all movements of the distributor boom must stop within an appropriate time frame when the remote control is let go of, so as to preclude risks for persons in the vicinity of the large manipulators. Therefore, the active oscillation damping has to be switched off once the control lever has reached the zero-position range when no additional measures have been taken in order for the active oscillation damping to be kept in operation.

A device of the type mentioned at the outset is disclosed in the European patent document EP 1 373 661 B1. The active oscillation damping here is switched on when the control lever is guided out of the initial position thereof in the zero-position range to the travel range. When the control lever is guided back to the zero-position range, the active damping is not switched off immediately but by way of a time relay. On account thereof, the active damping can remain switched on for up to 3 seconds beyond the switching signal. The above-mentioned machine directive prohibits any longer operation of the active damping. However, this measure is therefore suitable only to a limited extent for adequately damping the oscillations on account of an abrupt stoppage of the movement of the distributor boom, since the oscillations of the system have not yet faded after three seconds, despite damping. Said measure is unsuitable for damping the above-described oscillations of the boom tip while the boom is not moved and concrete is pumped through the conveyor line. The prior art therefore proposes that for this case a button having an additional function in the sense of a dead-man switch is provided on the remote control apparatus beside the control lever, so as to keep the damping function switched on also in the operation of the pump. This means that the machine operator for a continuous activation either has to remove his/her hand from the control lever or has to resort to his/her second hand, on account of which the ease of operation is impeded.

It is therefore the object of the invention to keep the active oscillation damping in operation even when the control lever is not in the travel range, without substantially impeding the ease of operation herein.

Proceeding from a device of the type mentioned at the outset, the invention in order for this object to be achieved proposes that the control lever is specified such that the latter is suitable for switching on the active oscillation damping without causing any movement of the large manipulator.

On account of this measure, the machine operator is capable of keeping the active oscillation damping of the large manipulator in operation even when the control lever is not located in the travel range. Said machine operator herein has neither to let go of the control lever nor resort to the other hand in order for a dead-man switch or similar that is disposed remotely from the control lever to be operated.

Expediently the active oscillation damping is switched off when the control lever is located in the zero-position range and an oscillation damping range is located between the outer travel range and the inner zero-position range of the control lever, and a deflection of the control lever to said oscillation damping range leads to the active oscillation damping being switched on without causing any movement of the distributor boom.

It is expedient for the control lever on the remote control apparatus to be mounted so as to be pivotable about two pivot axes that run so as to be mutually orthogonal and orthogonal to the longitudinal axis of the control lever. On account of this embodiment, additional functions can be carried out by the control lever in the same mode. Both pivot axes herein, depending on the pivot angle, are assigned a zero-position range, an oscillating damping range, and a travel range.

One refinement of the invention provides that the control lever is mounted so as to be rotatable about the longitudinal axis thereof, and said control lever to be mounted so as to be rotatable about an initial position and, depending on the rotation angle, in relation to the initial position of said control lever has an inner zero-position range, an outer travel range, and disposed therebetween an oscillation damping range, and a deflection of the control lever to said oscillation damping range leads to the active oscillation damping being switched on without causing any movement of the large manipulator. On account of this additional mobility of the control lever, further functions can be carried out by way of the control lever without changing the mode herein.

It is furthermore purposeful when it is displayed by way of one or a plurality of visual and/or acoustic signals that emanate from the remote control apparatus whether the control lever is located in the travel range, in the oscillating damping range, or the zero-position range. On account of said signals, the machine operator knows at all times in which range the control lever is located.

It is furthermore expedient for the control lever by way of a restoring mechanism to be capable of being automatically restored to the initial position of said control lever, and the restoring force, or the rotary restoring force, respectively, of the control lever to increase abruptly, or for a haptically noticeable threshold to have to be crossed, respectively, in the transition from the oscillation damping range to the travel range. On account of this abrupt increase in the restoring force, or the rotary restoring force, respectively, of the control lever, the machine operator directly notices when he/she is at the transition from the damping to the travel range, and first has to overcome the increased resistance in order for the control lever to be moved to the travel range. On account thereof, any inadvertent movement of the control lever to the travel range becomes significantly less probable.

One refinement of the invention furthermore provides that a push button is attached to the control lever, and that the activation of the push button switches on the active oscillation damping. The machine operator, by way of continuously activating the push button, can leave the active oscillation damping in the switched-on state. Said machine operator herein neither has to let go of the control lever nor resort to the other hand in order for a dead-man switch or similar that is disposed remotely from the control lever to be operated.

Additionally, it is purposeful for three different operating modes to be selectable on the remote control apparatus in the case of an activated active oscillation damping and in the case of a control lever that is located in the travel range, specifically a stationary mode and one or a plurality of travel modes, for example a slow travel mode and a rapid travel mode. If the large manipulator is not to be displaced for a long time, for example by virtue of a comparatively long concreting procedure, the machine operator can switch to the stationary mode such that only the oscillation damping is activated also in the travel range of the control lever. On account of this switched state, triggering an unintentional movement of the large manipulator is not possible. If the large manipulator is currently being retracted or deployed, the rapid movement mode is expedient, while the slow movement mode is best suitable when repositioning on site, in particular in order to preclude any risk to the operating personnel.

Finally, a further design embodiment of the invention results in the case of systems which as an additional operating mode have a so-called Cartesian control of the boom tip (cf. document EP 0686224 B2, for example). In this operating mode, a movement for the boom tip or the end hose attached thereto can directly be predefined in Cartesian coordinates (or polar coordinates) by way of the control lever or control levers, said coordinates from the control being converted mathematically to movement of velocities of the individual articulations. The movement of the boom can thus be operated by way of a single control lever as long as the latter has at least three degrees of freedom or adjustment directions, respectively. However, a second control lever, usually present, remains unused in this mode, that is to say that any deflection of said second control lever does not lead to any movement of the boom. It is proposed according to the invention in the operating mode of the Cartesian control, which in an analogous manner means a stationary mode for the second control lever, the active oscillation damping is switched on by the deflection of the second control lever in one of the adjustment directions present thereof. A further possibility for switching on and off the active oscillation damping in the operating mode of the Cartesian control is available to the operator on account of this solution. The ease of operation of the overall system is enhanced on account thereof, without an additional dead-man function that is separate from the joystick being required to this end.

Figure 2:
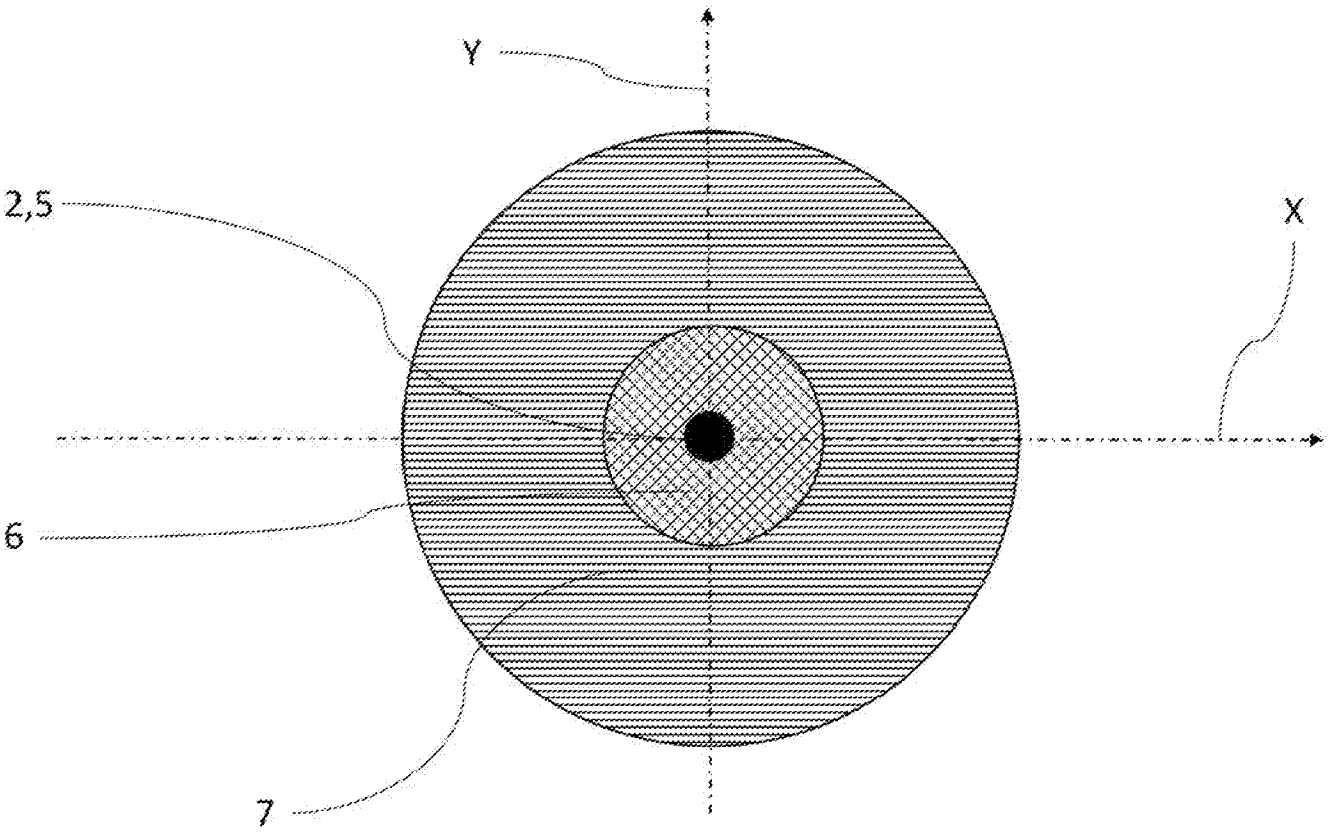
Figure 3:
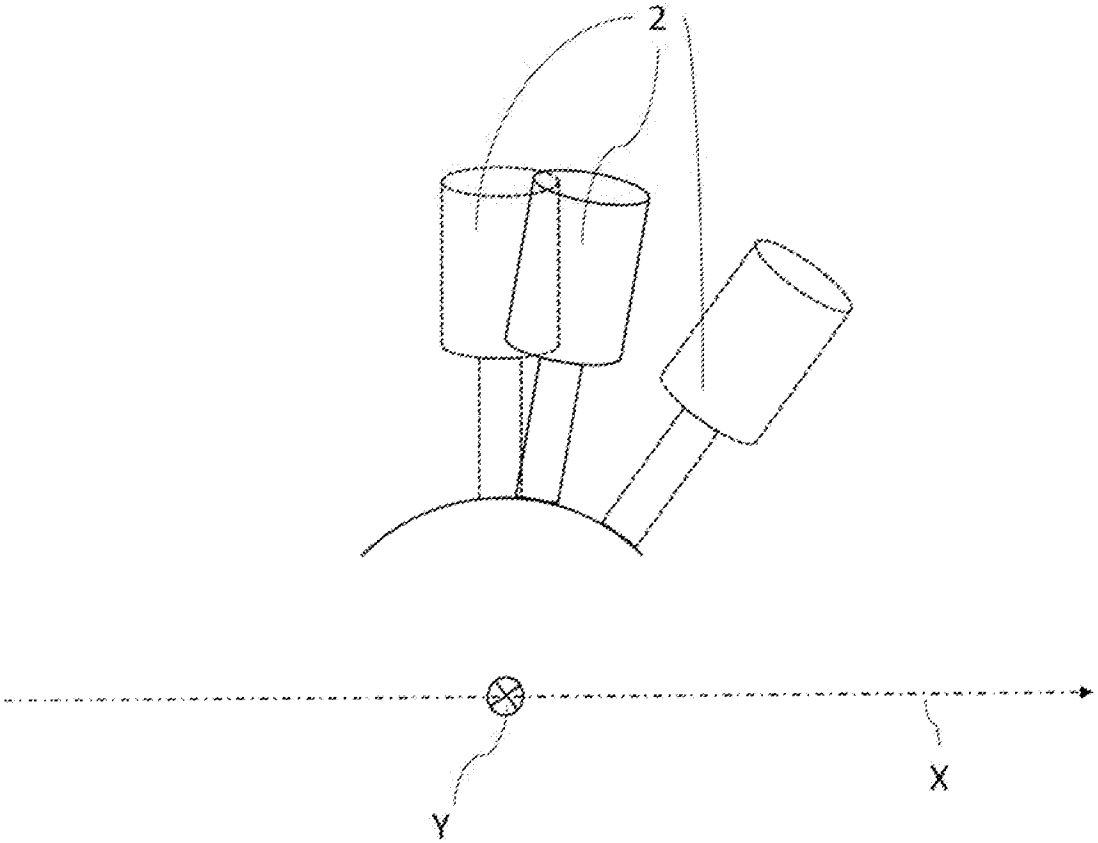
Figure 4:
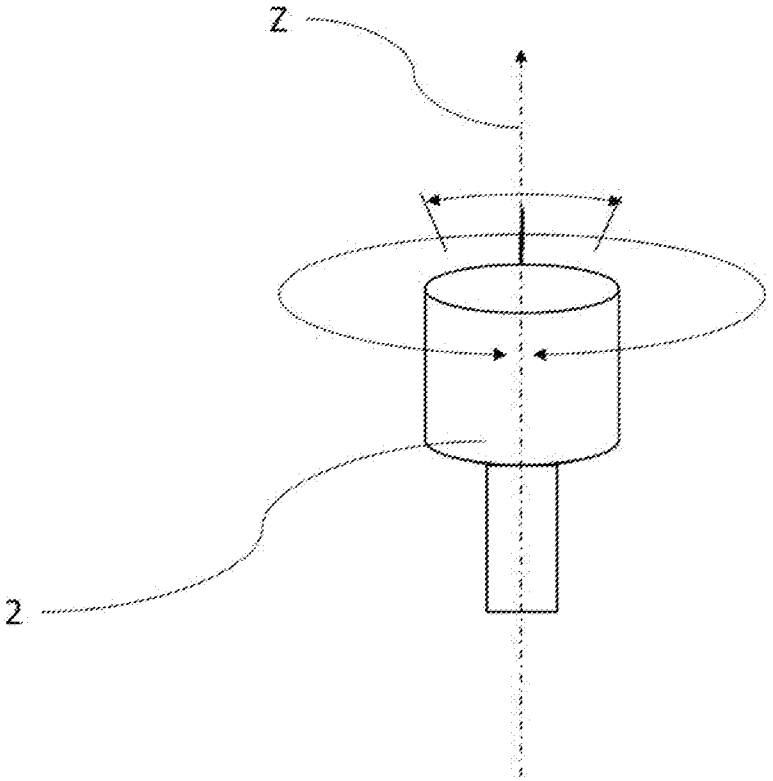
Figure 5:
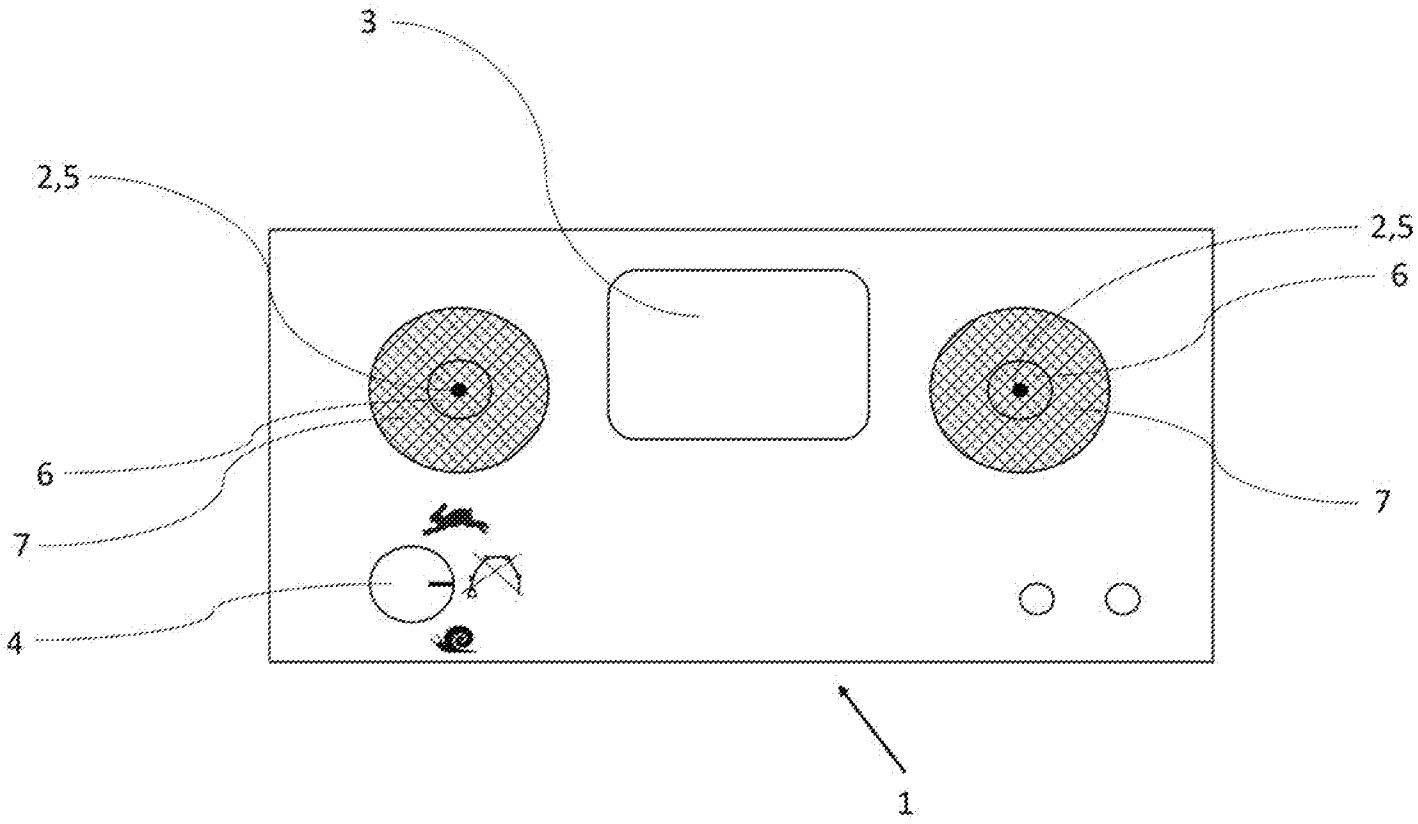
Figure 6:
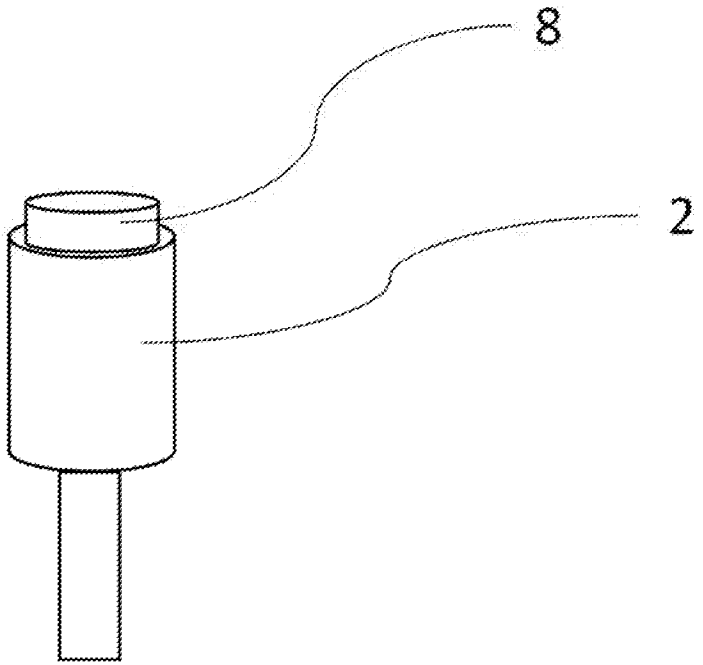

An exemplary embodiment of the invention will be explained in more detail hereunder by means of drawings in which:

FIG. 1: schematically shows a plan view of a remote control apparatus according to the invention;

FIG. 2: shows a detailed view of the region A from FIG. 1;

FIG. 3: schematically shows the movement of the control lever from FIG. 1 in a lateral view;

FIG. 4: schematically shows the rotatability of the control lever from FIG. 1 about the longitudinal axis of said control lever in a lateral view;

FIG. 5: schematically shows the remote control apparatus from FIG. 1 in a second operating mode; and FIG. 6: shows a schematic view of a control lever in a second exemplary embodiment.

A remote control apparatus according to the invention in its entirety is identified by the reference sign 1 in the drawings.

The remote control apparatus 1 for a truck-mounted concrete pump is shown in a schematic plan view in FIG. 1. Two control levers 2 by way of which a distributor boom of the truck-mounted concrete pump can be moved are attached to the remote control apparatus 1. The remote control apparatus 1 furthermore has a display 3 by way of which mainly status displays are displayed. A selector switch 4 by way of which three operating modes, that is to say two travel modes, the "rapid movement mode" (symbolized by a hare), the "slow movement mode" (symbolized by a snail), and a "stationary mode" (symbolized by a crossed-out distributor boom) can be selected is furthermore provided on the remote control apparatus 1. The operating mode set here is the "rapid movement mode".

The control lever 2 by way of various measures is specified for switching on the active oscillation damping of the large manipulator without causing any movement of the large manipulator. These measures will be explained in more detail hereunder.

The two control levers 2 on the remote control apparatus 1 are mounted so as to be pivotable counter to a restoring force about two pivot axes X, Y that run so as to be orthogonal to the longitudinal axis of said control levers 2, and have a zero-position range 5, an oscillation damping range 6, and a travel range 7.

The three ranges in FIG. 2 are illustrated in an enlarged manner in the detailed view of the region A from FIG. 1. If the control lever 2 is located in the zero-position range 5 thereof, the active oscillation damping of the large manipulator is not switched on. The zero-position range 5 is small compared to the other two ranges, such that a very small pivot angle is already sufficient for moving the control lever 2 from the zero-position range 5 to the oscillation damping range 6. When the control lever 2 by the machine operator is now moved from the zero-position range 5 to the oscillation damping range 6, the active oscillation damping of the truck-mounted concrete pump is switched on. The distributor boom of the truck-mounted concrete pump is however not yet repositioned. When the machine operator moves the control lever 2 further to the travel range 7, the distributor boom is repositioned depending on the respective selected operating mode. When the machine operator lets go of the control lever 2, the latter on account of the restoring mechanism thereof automatically returns to the zero-position range 5.

The force of the restoring mechanism is purposefully abruptly increased at the transitions of the individual ranges, or the transitions have a haptic threshold that is noticeable to the machine operator, respectively, without the restoring force in the travel range 7 and in the oscillation damping range 6 necessarily being dissimilar. It is additionally displayed by way of the display 3 in which range the control lever 2 is in each case located. When the distributor boom has reached the target position thereof, the machine operator moves the control lever 2 from the travel range 7 to the oscillation damping range 6, the distributor boom is stopped, and the active oscillation damping simultaneously remains switched on without the machine operator having to change his/her grip in any manner. The ease of operation is thus very simple.

FIG. 3 schematically shows such a motion sequence. The control lever 2 there is pivoted from the initial position thereof about the pivot axis Y.

The control lever 2 in this exemplary embodiment is mounted so as to be additionally rotatable about the longitudinal axis Z of said control lever 2. This is schematically illustrated in FIG. 4. In a manner analogous to the pivot axes X, Y that run so as to be orthogonal to the longitudinal axis Z, the control lever 2 in the case of a rotation about the longitudinal axis Z thereof, depending on the rotation angle, also has a zero-position range, an oscillation damping range, and a travel range.

The remote control apparatus 1 illustrated in FIG. 5 by way of the selector switch 4 is set to the operating mode "stationary mode". The control levers 2 here likewise have the zero-position range 5, the oscillation damping range 6, and the travel range 7. However, the movement function of the distributor boom of the truck-mounted concrete pump in this operating mode is not switched on by way of the control levers 2. The active oscillation damping however remains switched on also in the travel range 7. This operating mode is particularly well suited to comparatively long concreting procedures in which the distributor boom does not have to be moved for a comparatively long time, but oscillation nevertheless arises on the distributor boom on account of pumping procedures. Each pivoting or rotating movement of the control lever 2 can thus be used by the machine operator for switching on the oscillation damping without causing any travel movement of the boom.

FIG. 6 shows another embodiment of the control lever 2. The control lever 2 here has an additional push button 8 having a dead-man function by way of which the active oscillation damping remains active. If the additional push button 8 is activated, the active oscillation damping remains switched on also in the zero-position range 5 without the machine operator having to change his/her grip in any manner. The ease of operation is thus very simple.

The functionality of the push button in mechanical terms can also be achieved such that the entire control lever is depressed from above in the direction of the remote control unit and on account thereof a switching mechanism below the control lever is triggered, said switching mechanism activating the oscillation damping.

The functionality of the push button in the stationary mode here too can be used for switching on the oscillation damping.

When the large manipulator as an additional operating mode has a so-called Cartesian in control of the boom tip, a movement for the boom tip or the end hose attached thereto can directly be predefined in Cartesian coordinates (or polar coordinates) by way of the control lever or control levers 2, said coordinates from the control being converted mathematically to movement of velocities of the individual articulations. The movement of the boom can thus be operated by way of a single control lever 2, as long as the latter has at least three degrees of freedom or adjustment directions, respectively. However, a second control lever 2, usually present, remains unused in this mode, that is to say that any deflection of said second control lever does not lead to any movement of the boom. In this operating mode of the Cartesian control, which in an analogous manner means a stationary mode for the second control lever 2, the active oscillation damping is switched on by the deflection of the second control lever 2 in one of the adjustment directions present thereof. A further possibility for switching on and off the active oscillation damping in the operating mode of the Cartesian control is available to the operator on account of this solution. The ease of operation of the overall system is enhanced on account thereof, without an additional dead-man function that is separate from the control levers 2 being required to this end.

The invention claimed is:

1. A device comprising:

a remote control apparatus including a control lever that is pivotably mounted to the remote control apparatus, the control lever being pivotable within an inner zero-position range, an outer travel range, and an oscillation damping range located between the inner zero-position range and the outer travel range, the remote control apparatus is configured to:

cause movement of a large manipulator, which has an active oscillation damping mode, switch on the active oscillation damping mode and cause movement of the large manipulator when the control lever is within the outer travel range, switch off the active oscillation damping mode when the control lever is located in the zero-position range, and switch on the active oscillation damping mode without causing movement of the large manipulator when the control lever is located within the oscillation damping range.

2. The device of claim 1, wherein the control lever is mounted to be pivotable about at least two pivot axes that are orthogonal to a longitudinal axis of the control lever.

3. The device of claim 1, wherein a restoring force is applied against the control lever such that the restoring force must be overcome to transition the control lever from the oscillation damping range to the outer travel range.

4. The device of claim 1, wherein control level includes a push button, wherein the remote control apparatus is configured to switch on the active oscillation damping mode in response to activation of the push button.

5. The device of claim 1, wherein the remote control apparatus includes a travel mode and a stationary mode, wherein an activation of the control lever in the stationary mode switches on the active oscillation damping.

6. The device of claim 5, wherein the control level includes a push button, wherein activation of the push button in the stationary mode switches on the active oscillation damping.

* * * * *